United States Patent [19]

Natinsky

[11] 4,267,668

[45] May 19, 1981

[54] POWER WINDOW LIFT ASSEMBLY

[76] Inventor: Ronald E. Natinsky, 6727 Rolling Vista, Dallas, Tex. 75248

[21] Appl. No.: 33,529

[22] Filed: Apr. 26, 1979

[51] Int. Cl.[3] ..... E05F 15/08

[52] U.S. Cl. ..... 49/349; 49/139

[58] Field of Search ..... 49/346, 139, 353, 350, 49/351

[56] References Cited

U.S. PATENT DOCUMENTS

| | | | |
|---|---|---|---|
| 2,777,688 | 1/1957 | Ehrlich et al. | 49/349 X |
| 2,921,783 | 1/1960 | Wentz | 49/349 |
| 3,404,485 | 10/1968 | Henderson et al. | 49/349 |

*Primary Examiner*—Kenneth Downey

*Attorney, Agent, or Firm*—Kenneth R. Glaser

[57] ABSTRACT

A power lift assembly for applying a rotary cranking force to the crank stub of a mechanical window crank in an automobile door is disclosed. The power lift assembly is intended for use in combination with an automobile door having interior and exterior side panels enclosing a compartment, a window mounted for reciprocal movement into and out of the compartment, and a mechanical crank assembly contained within the compartment and coupled intermediate the door and window. The force required to raise and lower the window is developed by an electrical drive motor which is mounted on the interior panel at a remote location relative to the crank stub. The rotary driving force developed by the drive motor is transmitted to the crank stub through a flexible drive shaft and a worm and gear assembly which is coupled directly to the crank stub. A switch assembly is provided for selectively applying electrical excitation from a power source to the drive motor, and includes a support housing which encloses the switch assembly and the gear assembly. Travel of the window is limited by the existing channel structure of the door with drive motor overheat control being provided by a self-interrupting and self-resetting current responsive switch coupled in series electrical circuit relation with the field winding of the drive motor.

3 Claims, 4 Drawing Figures

POWER WINDOW LIFT ASSEMBLY

BACKGROUND OF THE INVENTION

1. Field of the Invention

The present invention relates generally to the field of automobile accessories, and in particular to an electromechanical power lift assembly for operating an automobile door window.

2. Description of the Prior Art

Most automobiles are provided with a manually operated, hand crank assembly for raising and lowering the door windows. In such conventional arrangements, the automobile door has interior and exterior side panels enclosing a compartment with a window mounted for reciprocal movement into and out of the compartment. A mechanical crank assembly is lodged inside the compartment and coupled intermediate the door and window with a crank stub projecting through the interior side panel for engaging a manually operable crank handle. In this arrangement, a rotary crank force applied to the crank stub is transmitted directly through a gear to a scissors jack or other assembly for extending and retracting the window.

A popular feature which is provided on an optional basis is an electrically operated power window lift assembly in which the manually operated crank apparatus is eliminated. In the conventional power window arrangement, an electrical switch is provided for applying operating power to a drive motor which is coupled directly to the scissors jack and window, with rotation of the drive motor being translated into vertical movement of the window by means of the scissors jack and a rack and gear assembly.

Field conversion of a manually operated mechanical window lift assembly to a power lift assembly having factory components is not practical because access to the interior of the welded door panel assembly is limited and because of the special tooling required for the removal and installation of welded components within the door panel. Various prior art attempts to convert a manual lift assembly into a power lift assembly have been generally unsatisfactory for the foregoing reasons and because of the difficulty of applying a rotary cranking force to the existing crank stub in an arrangement which is both efficient and aesthetically pleasing. A further problem which has limited the success of prior art arrangements is the provision of a satisfactory window travel limit control to prevent overheating the drive motor when operating power is continuously applied after the window has reached its fully extended or fully retracted position.

OBJECTS OF THE INVENTION

It is, therefore, the principal object of the present invention to provide a power window lift assembly which can be installed in the field with commonly available tools to convert a manually operated window lift assembly into a power lift assembly.

Another object of the invention is the provision of a power lift window assembly which can be installed in the field with minimum structural modification of an existing door panel.

Yet another object of the invention is the provision of a power lift assembly in which a rotary cranking force is applied efficiently to the existing crank stub of a mechanical crank assembly in an arrangement which is aesthetically pleasing.

Still another object of the invention is the provision of an electromechanical drive assembly for applying a rotary cranking force to the crank stub of a manually operated window crank assembly with an electrical drive motor which is located in a position which is relatively remote with respect to the crank stub.

Yet another object of the invention is the provision of a switching circuit for controlling the operation of an electrical drive motor in a power window lift assembly which will provide for the full retraction or extension of the window without risk of overheating the drive motor as the window is driven to the limits of its travel.

SUMMARY OF THE INVENTION

The foregoing objects are achieved by a power lift assembly which may be installed in combination with the existing mechanical window crank assembly in a vehicle door which includes an electrical drive motor for producing a rotary driving force in response to electrical excitation, a flexible drive shaft for transmitting a rotary cranking force from the drive motor to the crank stub of the mechanical window crank assembly, a worm and gear assembly connected intermediate the flexible drive shaft and the crank stub having a rotary socket for engaging the crank stub, and a switching circuit having input terminals and output terminals for applying electrical excitation from a power source to the drive motor.

In a preferred embodiment, the drive motor is mounted on the interior panel of the door at a remote location relative to the crank stub with the worm gear assembly being mounted on the interior structural panel overlying the crank stub. The crank stub is received in torque transmitting engagement with the rotary socket through the panel. In this preferred arrangement, the switch assembly includes a support housing having side portions defining a cavity and a manually operable actuator mounted on the support housing and received within the cavity, with the switch housing being supported by the interior side panel, and the crank stub and worm gear housing being received within the cavity and enclosed by the switch housing.

Window travel limit control is provided by the reaction force developed as the window is driven against the upper and lower window casing structure. The window is driven through full retraction and extension without risk of overheating the drive motor by the provision of a self-interrupting and self-resetting current responsive switch connected in series electrical circuit relation with the field winding of the drive motor. According to this arrangement, the current responsive switch opens automatically to prevent overheating of the drive motor in response to an increased level of current flow sustained for a predetermined length of time which corresponds with the increased current flow conditions in the drive motor under maximum load conditions caused by the reaction forces developed as the window is driven to its fully retracted or fully extended position.

These and other related objects and advantages of the present invention will become more apparent from the following specification, claims and appended drawings wherein:

DESCRIPTION OF THE PREFERRED EMBODIMENT

Figure 1:
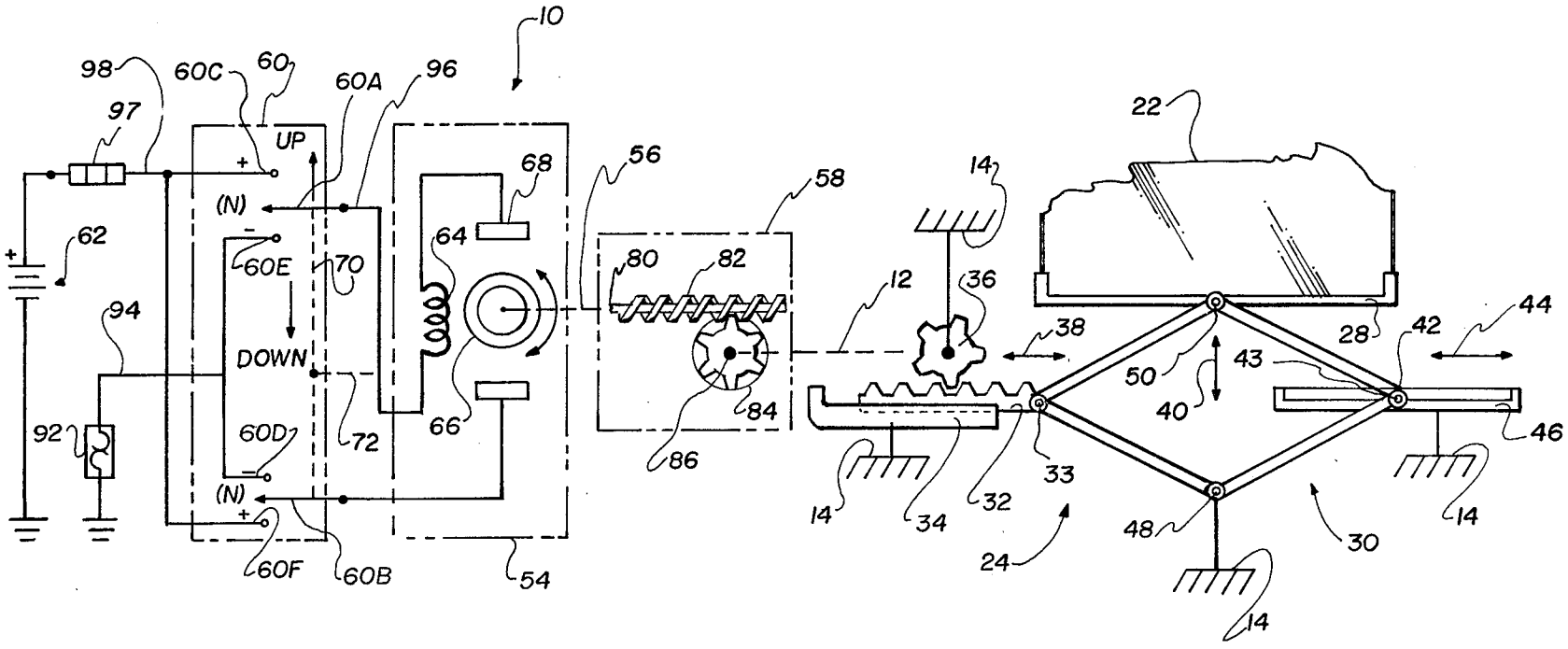
FIG. 1 is a schematic electro-mechanical diagram of the power lift assembly of the invention.

In the description which follows, like parts are marked throughout the specification and drawing figures with the same reference numerals, respectively. The figures are not necessarily drawn to scale and in some instances portions have been exaggerated in order to more clearly depict certain features of the invention.

Figure 2A:
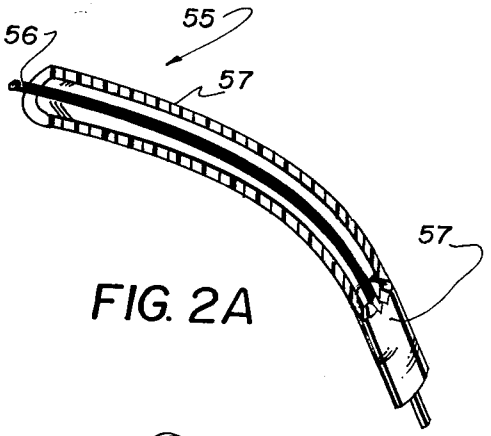
FIG. 2 is an exploded perspective view which illustrates a preferred field installation for the power lift assembly of the present invention; and, FIG. 2A is an elevation view, partly in section, of a flexible drive shaft assembly.
Figure 2:
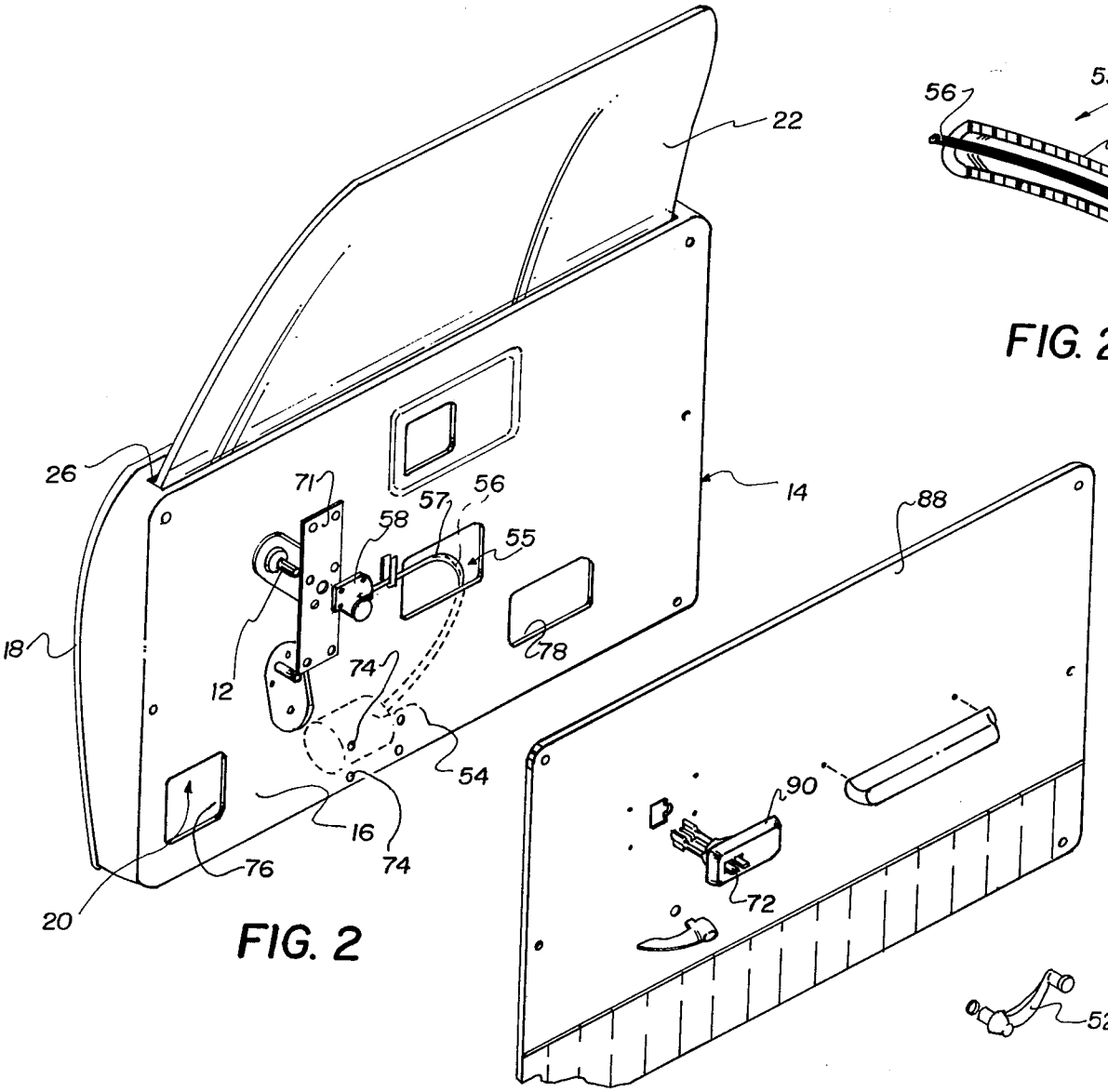

Referring now to FIGS. 1 and 2, a power lift assembly 10 for applying a rotary cranking force to the crank stub 12 of a mechanical window crank in an automobile door 14 is disclosed. The power lift assembly 10 is shown in combination with the automobile door 14 having an interior side panel 16 and an exterior side panel 18 enclosing a compartment 20. A window 22 is mounted for reciprocal movement into and out of the compartment 20.

A mechanical crank assembly 24 (FIG. 1) is coupled intermediate the door and window for extending and retracting the window through a slot 26 in the door. The window 22 is supported for vertical movement through the slot 26 by means of a carriage assembly 28. Extension and retraction of the window is provided by a scissors jack assembly 30 in the conventional manner. The scissors jack assembly 30 is pivotally coupled to a rack 32 at apex 33, and is confined within a channel guide member 34 for horizontal movement in response to rotation of a rotary gear 36. Horizontal reciprocal movement of the rack 32, as indicated by the arrow 38, is translated into vertical reciprocal movement of the scissors jack assembly 30, as indicated by the arrow 40. A roller 42 is coupled to the diagonally opposite apex 43 of the scissors jack assembly and is confined in a channel guide member 46 for horizontal reciprocal movement as indicated by the arrow 44. The lowermost apex 48 of the scissors jack assembly is pivotally anchored to the door 14 while the uppermost apex 50 of the jack assembly is pivotally coupled to the window carriage assembly 28. According to this arrangement, rotation of the rotary gear 36 drives the rack 32 and thereby causes a vertical displacement of the window 22.

In the conventional manually operated, hand crank assembly, a window crank handle 52 (FIG. 2) is coupled to the crank stub 12 for extending and retracting the window 22. According to the present invention, the window crank handle 52 is removed from the crank stub 12 and the force required to raise and lower the window is developed by an electrical drive motor 54 which is mounted on the interior panel 16 at a remote location relative to the crank stub. The rotary driving force developed by the drive motor 54 is transmitted to the crank stub 12 through a flexible drive shaft assembly 55 and a worm gear 58 which is coupled directly to the crank stub. The flexible drive shaft assembly 55 includes a shaft 56 concentrically received within a tubular housing 57 as shown in FIG. 2A. The shaft 56 is preferably constructed of high strength steel.

The function of the flexible drive shaft assembly 55 is to transmit the rotary power developed by the remotely located electric motor 54 to the shaft 80 of the worm gear 58. A flexible drive arrangement is necessary because the drive motor cannot be mounted for direct in-line connection to either the worm gear or to the crank stub 12. The flexible drive shaft 56 is enclosed within the tubular housing 57 which is preferably constructed of a durable material such as polypropylene or nylon. Bearings (not shown) are formed at each end of the worm shaft 80 and support the flexible shaft 56 for rotation within the tubular housing 57.

A switch assembly 60 is provided for selectively applying electrical excitation to the drive motor from a power source 62. For most installations, the power source 62 will be the DC storage battery of the vehicle.

The drive motor 54 is preferably a reversible DC electric motor having a field winding 64, a rotor member 66 and a brush assembly 68 for commutating electrical current to the rotor member in the conventional manner. A reversal of the direction of rotation of the rotor member 66 is provided by reversing the polarity of the excitation applied to the field winding 64.

The application and reversal of excitation to the drive motor 54 is provided by the switch assembly 60 which is preferably embodied in a double pole, double throw switch having a neutral position (N). As shown in FIG. 1, the switch assembly includes pole members 60A, 60B which are mechanically coupled by a linkage 70 for concurrent movement from a neutral resting position (N) to simultaneously engage positive and negative terminals 60C, 60D, respectively, and for simultaneously engaging negative and positive terminals 60E, 60F, respectively, when moved in the opposite direction. The mechanical linkage 70 includes an actuator toggle 72 which permits manual selection of up, neutral (or off) and down modes of operation. The mechanical linkage 70 is preferably spring biased to return the actuator to the neutral position when the actuator toggle 72 is released.

In the preferred installation as shown in FIG. 2, the drive motor 54 is mounted onto the interior side panel 16 at a location which is relatively remote with respect to the crank stub 12. Since this installation is carried out in the field, with commonly available tools, the structural modification of the door panel 16 must be held to a minimum. Therefore the drive motor 54 is preferably mounted on the inside of the compartment 20 and directly onto the interior side panel 16. The only structural modification required is the drilling of four holes for attaching a mounting bracket (not shown). The motor is inserted into the compartment through one of the convenient access openings 76, 78 which are commonly provided in the interior side panel structure.

The rotary driving force developed by the drive motor 54 is transmitted to the crank stub 12 by the flexible drive shaft assembly 55 and the worm gear 58. The function of the worm gear 58 is to connect the non-parallel, non-intersecting flexible drive shaft and crank stub which are mutually perpendicular. The worm gear includes a shaft 80 to which the flexible drive shaft 56 is attached, and a continuous tooth or thread 82 extending around the pitch surface of the shaft 80. The thread 82 is engaged with the teeth of a worm wheel 84. The worm wheel 84 includes a rotary socket 86 having grooves for engaging spline portions of the crank stub 12 for efficiently transmitting the rotary force developed by the drive motor 54. The rotary socket 86 is preferably removable and interchangeable with similar sockets having larger or smaller opening sizes to accommodate different crank styles. The housing of the worm gear 58 may be attached directly to the interior structural panel 16, or it may be attached via a mounting bracket 71 as illustrated in FIG. 2.

Figure 3:
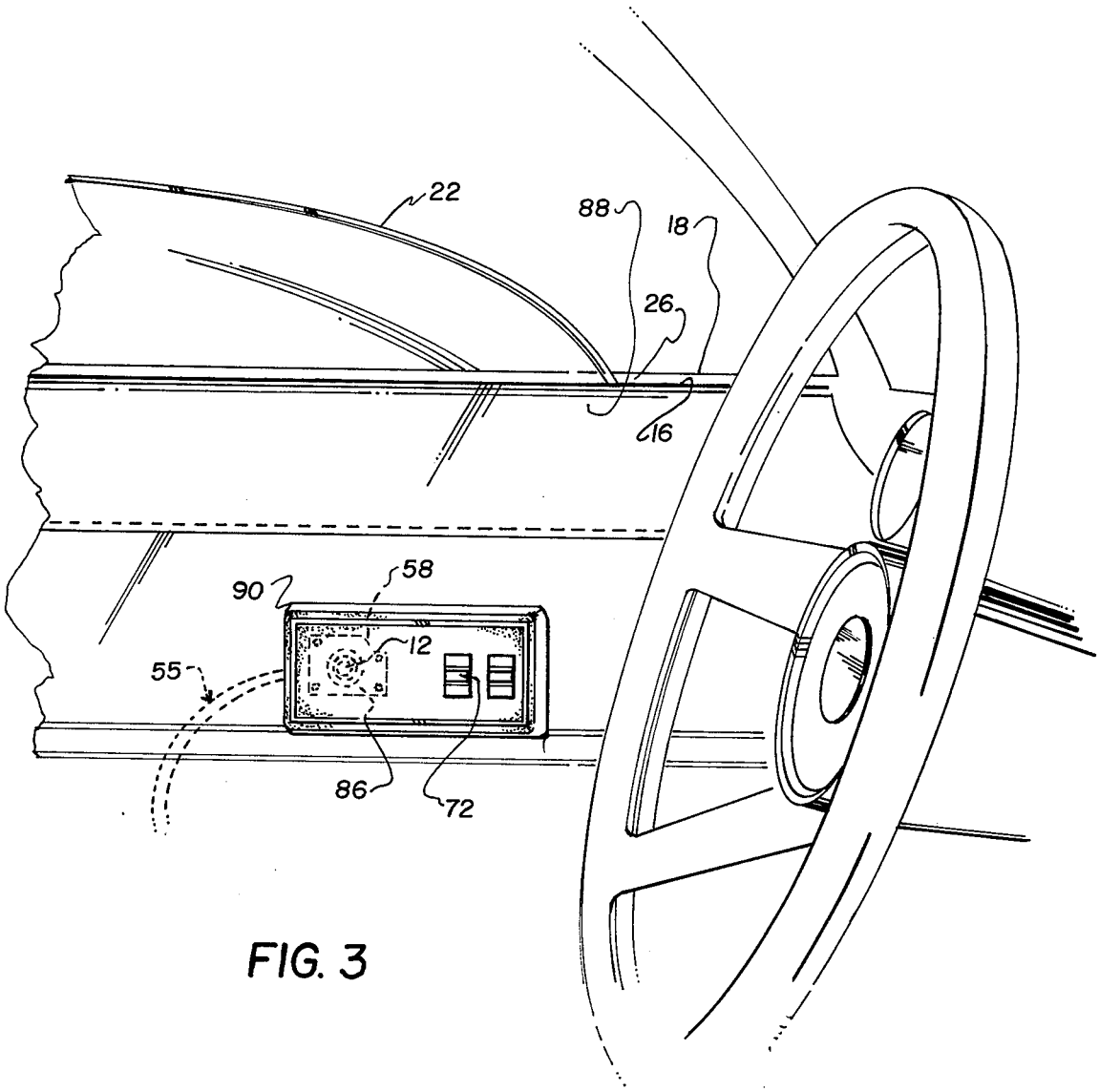
FIG. 3 is a perspective view illustrating the external appearance of the power lift assembly of the present invention as installed in an automobile door.

For aesthetic considerations it is desirable that the power lift assembly 10 take up a minimum amount of space within the interior of the automobile and that modification or alteration of the interior door trim panel 88 be held to a minimum. Because of the construction of the worm gear, a portion of the rotary socket housing necessarily projects through the trim panel and into the interior of the automobile. An additional requirement is that the toggle actuator 72 of the switch assembly 60 should be located in a convenient, accessible location with respect to the operator. These features are provided for by a decorative switch housing 90 which is attached to the trim panel 88. The switch housing 90 is generally rectangular in form and includes side portions defining a cavity in which the switch assembly and the worm gear are received and enclosed. Thus the switch actuator and switch housing are the only components of the power lift assembly 10 which are visible in the completed installation as shown in FIG. 3 of the drawing. Furthermore, the switch housing 90 is mounted directly over the crank stub 12 in the position formerly occupied by the window crank handle 52 which is removed from the crank stub. The position of the worm gear 58 within the cavity of the decorative switch housing is indicated by the dashed phantom lines in FIG. 3. The resulting installation is attractive, takes up a minimum amount of space, and provides for the efficient transmission of the rotary cranking force from the drive motor 54 to the crank stub 12.

In operation, the toggle actuator 72 is moved up or down to cause the window 22 to be extended and retracted. It is anticipated that the operator will depress the actuator and maintain electrical excitation on the drive motor for at least a few seconds longer than is necessary to fully retract or extend the window. Full extension of the window is especially important for providing airtight sealing engagement of the upper edge of the window with the resilient flashing which is usually provided along the window structure. Since the operator cannot detect the exact moment that positive sealing engagement occurs, he will tend to hold the actuator in the up position for at least a few seconds more than is required. This can cause the drive motor 54 to draw an unacceptably large current flow through its field winding 64 when the rotor member 66 is suddenly stopped in response to the reaction forces applied to the window as it becomes fully extended or retracted.

In order to protect the drive motor from over-temperature damage caused by such an operation, a self-interrrupting and self-resetting current responsive switch 92 is connected in series circuit relation with the field winding 64. The current reponsive switch 92 is preferably connected in series with the common ground conductor 94 of the switch assembly 60. However, the current responsive switch 92 could be connected in series relation with the field conductor 96 if desired. The current responsive switch 92 preferably has a response time in the order of ten to fifteen seconds for opening the ground circuit in response to an overload condition caused by continuously driving the window in the fully extended or fully retracted position.

A conventional fuse 97 is connected in series electrical circuit relation with the positive power conductor 98 which is connected to the power source 62. The purpose of the fuse 97 is to protect the wiring from overheat damage in the event of a short circuit.

From the foregoing description of a preferred embodiment, it will be apparent that the power window lift assembly of the invention can be easily installed in the field with commonly available tools for converting a manually operated window lift assembly into a power lift assembly. Installation requires minimum alteration and structural modification of the interior side panel and trim panel. The use of the worm gear and flexible drive shaft permits the drive motor to be mounted in a remote location relative to the crank stub so that the motor may be placed in a convenient available space within the door compartment. The direct engagement of the worm gear with the existing crank stub provides the efficient transmission of the rotary cranking force developed by the drive motor and the decorative switch housing when installed over the crank stub shields the worm gear housing from view while supporting the toggle actuator of the switch assembly in a convenient, easily accessible location. Finally, the current sensitive switch permits the operator to apply excitation to the drive motor for driving the window into full retraction or extension without risk of overheating the drive motor.

This invention may be embodied in other specific forms without departing from the spirit or essential characteristics thereof. For example, although a DC drive motor having a field winding and brushes is preferred, other reversible drive motors such as AC induction motors may be used to good advantage. The present embodiment should therefore be considered in all respects as illustrative, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. In a motor vehicle having a source of electrical current for providing operating power to accessories and having a door with a movable window and a mechanical crank assembly coupled intermediate the door and window, said crank assembly including a crank stub for engaging a manually operable crank handle, the combination with the mechanical crank assembly of an electromechanical drive assembly for applying a rotary cranking force to the crank stub, said electromechanical drive assembly comprising:

an electrical drive motor mounted on the door having a field winding and a rotor member for producing a rotary driving force in response to electrical excitation of the field winding;

a flexible drive shaft coupled intermediate the rotor and the crank stub for turning the crank stub in response to rotation of the rotor;

a manually operable switch assembly coupled intermediate the vehicle power source and the field winding for applying operating power to said drive motor; and, a self-interrupting and self-resetting current responsive switch coupled in series electrical circuit relation intermediate said power source and the field winding of said motor.

2. In a vehicle door having interior and exterior side panels enclosing a compartment, a window mounted for reciprocal movement into and out of the compartment, and a mechanical crank assembly disposed in the compartment and coupled intermediate the door and window, said crank assembly including a crank stub projecting through the interior side panel for engaging a manually operable crank handle, the combination with the manually operable crank assembly of an electromechanical drive assembly for applying a rotary cranking force to the crank stub, said electromechanical drive assembly comprising;

an electrical drive motor for producing a rotary driving force in response to electrical excitation, said drive motor being mounted on the interior panel at a remote location relative to the crank stub;

a flexible drive shaft coupled intermediate the motor and the crank stub for turning the crank stub in response to electrical excitation applied to the drive motor;

a worm gear having a rotary socket coupled intermediate the flexible drive shaft and the crank stub, said worm gear being mounted on the interior panel overlying the crank stub with the crank stub being received in torque transmitting engagement with the rotary socket;

a switch assembly for selectively applying electrical excitation from a power source to said drive motor, said switch assembly including a support housing having side portions defining a cavity and a manually operable actuator mounted on said support housing and received within the cavity, said housing being supported by the interior side panel with the crank stub and worm gear being received within the cavity and enclosed by said housing; and a trim panel attached to and overlying said interior side panel, said switch assembly support housing being attached to said trim panel with said switch assembly and said worm gear projecting through said trim panel.

3. In a motor vehicle having a source of electrical power for operating accessories and having a vehicle door including interior and exterior side panels enclosing a compartment, a window mounted for reciprocal movement into and out of the compartment, and a mechanical crank assembly disposed in the compartment and coupled intermediate the door and window, said crank assembly including a crank stub projecting through the interior side panel for engaging a manually operable crank handle, the combination with the manually operable crank assembly of an electromechanical drive assembly for applying a rotary cranking force to the crank stub, said electromechanical drive assembly comprising: an electrical drive motor mounted on the door in a remote location relative to the crank stub, said drive motor having a field winding and a rotor member for producing a rotary driving force in response to electrical excitation of the field winding; a flexible drive shaft coupled in torque transmitting engagement with the rotor member and crank stub, respectively; a worm gear having a rotary socket coupled intermediate the flexible drive shaft and the crank stub, said worm gear being mounted on the interior panel overlying the crank stub with the crank stub being received in torque transmitting engagement with the rotary socket; a switch assembly for selectively applying electrical excitation from the vehicle power source to said drive motor, said switch assembly including a support housing having side portions defining a cavity and a manually operable actuator mounted on said support housing and received within the cavity, said housing being supported by the interior side panel with the crank stub and worm gear being received within the cavity and enclosed by said housing; and said switch assembly including a switching circuit having input terminals electrically coupled to the vehicle power source, output terminals being coupled to the drive motor field winding, said manually operable actuator being coupled to said switching circuit for selectively reversing the polarity of the excitation applied to the drive motor field winding; and, a self-interrupting and self-resetting current responsive switch coupled in series electrical circuit relation intermediate the vehicle power source and the field winding of the drive motor.

* * * * *